United States Patent [19]

Link

[11] 4,082,866

[45] Apr. 4, 1978

[54] METHOD OF USE AND ELECTRICAL EQUIPMENT UTILIZING INSULATING OIL CONSISTING OF A SATURATED HYDROCARBON OIL

[75] Inventor: Edwin A. Link, Waukesha, Wis.

[73] Assignee: RTE Corporation, Waukesha, Wis.

[21] Appl. No.: 616,673

[22] Filed: Sep. 25, 1975

Related U.S. Application Data

[63] Continuation-in-part of Ser. No. 599,372, Jul. 28, 1975, which is a continuation of Ser. No. 433,053, Jan. 14, 1974, abandoned, which is a continuation-in-part of Ser. No. 292,670, Sep. 27, 1972, abandoned.

[51] Int. Cl.[2] ..... H01B 3/22; C10G 23/00

[52] U.S. Cl. ..... 427/294; 174/15 R; 174/17 R; 174/17 LF; 252/63; 208/14; 208/18; 208/19; 336/58; 336/94; 427/81

[58] Field of Search ..... 252/63; 174/17 R, 15 R, 174/17 LF; 336/94, 58; 208/14, 18, 19; 427/81, 294

[56] References Cited

U.S. PATENT DOCUMENTS

| | | | |
|---|---|---|---|
| 1,902,489 | 3/1933 | Clark | 252/63.2 |
| 3,011,972 | 12/1961 | Watson et al. | 208/38 |
| 3,431,198 | 3/1969 | Rausch | 208/264 |
| 3,494,854 | 2/1970 | Gallagher | 208/89 |
| 3,549,537 | 12/1970 | Brewster et al. | 208/14 |
| 3,551,324 | 12/1970 | Lillard | 208/14 |
| 3,642,610 | 2/1972 | Divijak | 208/58 |
| 3,732,154 | 5/1973 | Mills et al. | 208/87 |
| 3,753,188 | 8/1973 | Miyoshi et al. | 336/94 |
| 3,759,817 | 9/1973 | Mills et al. | 208/19 |
| 3,839,118 | 10/1974 | Mills et al. | 208/14 |
| 3,849,288 | 11/1974 | Milstein et al. | 208/14 |
| 3,909,435 | 9/1975 | Koga et al. | 252/63 |

OTHER PUBLICATIONS

Nanda et al, "Mixing of Transformer Oils" I.E. (I) Journal-EL, vol. 50, No. 12 (Aug. 1970).

Jirasek, "Some New Facts about Insulating and Lubricating Oils," The Refiner and Nat. Gasoline Manufacturer 12-1926.

Lipshtein et al, "Transformer Oil," © 1979.

*Primary Examiner*—Ralph S. Kendall
*Assistant Examiner*—John D. Smith
*Attorney, Agent, or Firm*—Ronald E. Barry

[57] ABSTRACT

The unique, relatively nonflammable, environmentally safe, insulating oil comprises a saturated hydrocarbon oil having a molecular weight of about 500 to about 700, and a fire point above 200° C. The electrical equipment comprises an oil-sealed tank, a unique insulating oil filling said tank, and an electrical component such as a conductive coil immersed in said insulating oil. A method of filling the oil-sealed tank of an electrical apparatus with the unique insulating oil also is disclosed.

9 Claims, 1 Drawing Figure

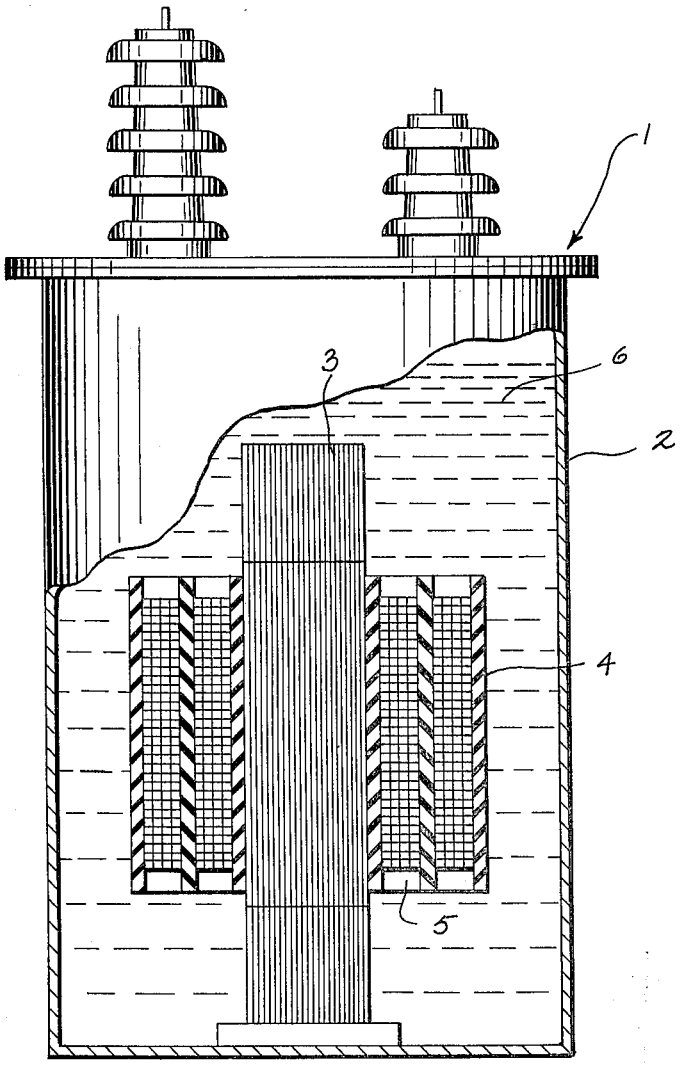
1
2
3
4
5
6

METHOD OF USE AND ELECTRICAL EQUIPMENT UTILIZING INSULATING OIL CONSISTING OF A SATURATED HYDROCARBON OIL

RELATED CASES

This application is a continuation-in-part of my copending application Ser. No. 599,372, filed on July 28, 1975 which is a continuation of my application Ser. No. 433,053 filed Jan. 14, 1974, (now abandoned), which was in turn a continuation-in-part of my application Ser. No. 292,670 filed on Sept. 27, 1972 and entitled "High Temperature Transformer Assembly" (now abandoned).

BACKGROUND OF THE INVENTION

An insulating oil for use in transformers and other electrical equipment has two important functions. First, it acts as an electrical insulating medium and second, it transports heat generated in the windings and core of the transformer or in connected circuits to cooling surfaces. In addition to possessing dielectric strength and cooling capacity, the ideal insulating oil should be environmentally safe and relatively nonflammable.

Hydrocarbon or mineral oils derived from crude petroleum oil were used extensively for many years as insulating oils in electrical equipment. However, such oils have been replaced to a great extent by less flammable oils. Since the 1930's the polychlorinated biphenyls (PCB) which are generally considered to be nonflammable have been widely utilized as replacements for mineral oils insulating oils in electrical equipment. Nonflammability is a required property for insulating oils to be used in equipment which is placed within and around building structures where it is necessary to minimize the hazard of fire and explosion damage in the event of electrical faults within the equipment.

In recent years, it has become generally recognized that polychlorinated byphenyls (PCB) are environmentally hazardous liquids. As a result, strict requirements have been established concerning the construction and the installation of equipment intended for use with such oils to prevent any fluid leakage in event of a catastrophic failure. In addition, the disposal of liquids or fluids containing PCB must now be made in compliance with the very exacting procedures outlined in the new environmental protection laws. Furthermore, the polychlorinated biphenyls because they lack the ability to extinguish internal arcing cannot be used in safety and operational devices such as submerged high voltage fuses, breakers and switches.

Because of the disadvantages and shortcomings of the polychlorinated biphenyls, there have been numerous efforts made to develop relatively inexpensive, environmentally safe, nonflammable insulating oils. To date these efforts have not been completely successful.

Representative of the prior art insulating oils are those disclosed in U.S. Pat. Nos. 3,000,807; 3,095,366; 3,406,111; 3,587,168 and 3,753,188.

SUMMARY OF THE INVENTION

It is the general object of the present invention to provide electrical equipment utilizing an insulating oil which is relatively nonflammable, biodegradable, environmentally safe, and comparatively inexpensive. More particularly it is an object to provide an insulating oil which minimizes the hazards that can result from catastrophic explosions during high fault conditions and to disclose the use of that oil in electrical equipment. Other objects and advantages will appear from the description to follow.

BRIEF DESCRIPTION OF THE DRAWING

The FIGURE is an elevational view partially in section of a power transformer employing the present invention.

DESCRIPTION OF PREFERRED EMBODIMENT

In the drawing, a transformer 1 is shown as comprising an oil-sealed tank 2, a ferrous metal core 3, a primary coil 4, a secondary coil 5 and an insulating oil 6 which surrounds and covers the core and coils. The oil-sealed tank 2, the core 3 and the coils 4 and 5 are of conventional construction. However, the insulating oil 6 is unique and will be described in detail hereafter.

I have made the surprising discovery that contrary to the teachings of the prior art there are certain highly refined petroleum oils or mineral oils which are sufficiently nonflammable to serve as insulating oil substitutes for the polychlorinated biphenyls in electrical equipment which is operated at moderate ambient temperatures of 0° to about 40° C. This is truly surprising as conventional transformer oils or known insulating oils derived from petroleum oils cannot be used as they are highly flammable and explosive under high fault conditions.

The oils I have found to be useful as insulating oils are comprised of straight and branched chain aliphatic paraffinic hydrocarbons, which have a molecular weight of about 500 to about 700, preferably about 600, and a fire point above 200° C, naphthenic hydrocarbon oils having similar characteristics and mixtures of the forementioned paraffinic and naphthenic hydrocarbons.

A suitable paraffinic oil is that available from the Sinclair Oil Company under the formula number L-1811. This oil is dual treat base oil which is solvent treated, deeply hydrogenated bright stock and is predominately paraffinic oil with a molecular weight in excess of 600. It has a distillation range by ASTM test — D1160 as follows. The initial boiling point at atmospheric pressure is 760° F; the 5% point is 891° F; and 10% point is 920° F; the 50% point is 1,050° F. Above 50% it is 1,051° to 1,250° F. It has an aniline point of 256° F (an indication of a high degree of paraffinic structure). This oil has characteristics as follows:

| | Formula |
|---|---|
| Gravity, ° API | 28.9 |
| Flash Point ° C | 296 |
| Fire Point ° C | 321 |
| K Vis. at 100° F, cs | 414.1 |
| K Vis. at 210° F, cs | 27.33 |
| Vis. at 100° F, SSU | 1919 |
| Vis. at 210° F, SSU | 130.5 |
| Extrapolated Vis. at 0° F, SSU-17.78° C | 450,000 |
| Pour Point ° F | −5 |
| Color | 30 |
| Sulfur, % | Less than 0.001 |
| Corrosive Sulvur (D-1275) | Pass |
| Vapor pressure at 200° C, mm Mercury | 0.01 |

The above oil may be prepared from a base oil having the following characteristics:

| | |
|---|---|
| Gravity, °API | 28.8 |

-continued

| | |
|---|---|
| Specific Gravity 60/60° F | 0.8826 |
| Flash, ° F | 565 |
| Pour, ° F | 25 |
| Color, Saybolt D-156 | +25 |
| Sulfur, % | 0.001 |
| Aniline Point, ° F | 276 |
| Acid Number | 0.00 |
| Refractive Index at 20° C | 1,4835 |
| Distillation, ° F, D-1160 | |
| IBP | 760 |
| 5% | 891 |
| 10% | 920 |
| 50% | 1050+ |
| 90% | — |
| UV Absorptivity at 250 mu | 0.028 |
| $TiO_2$ Discoloration, 48 hrs. | None |
| Specific Dispersion | 100.3 |

A suitable naphthenic oil is that available from Sinclair Oil Company under the formula Number N-1810. This oil is a dual treat base oil which is solvent treated, deeply hydrogenated bright stock and is predominately naphthenic oil with a molecular weight of about 600. This oil has characteristics as follows:

| | Naphthenic |
|---|---|
| Gravity, ° API | 14.8 |
| Flash Point, ° C | 204 |
| Fire Point, ° C | 237 |
| K Vis. at 100° F, cs | 40.13 |
| K Vis. at 210° F, cs | 4.88 |
| Vis. at 100° F, SSU | 187 |
| Vis. at 210° F, SSU | 42.3 |
| Extrapolated Vis. at 0° F, SSU | 45,000 |
| Pour Point ° F | −10 |
| Color | Dark |
| Sulfur, % | 0.94 |
| Corrosive Sulfur (D-1275) | Pass |
| Vapor Pressure at 200° C, mm Mercury | 2 |

Blends of the previously described and similar paraffinic and naphthenic oils can be also utilized as can mixtures prepared from Mid-Continental or mixed crudes. The percentage of each type of molecule in the oil is not critical provided the resulting mixture possesses the desirable high fire point and good dielectric properties.

Additional suitable oils may be prepared from a highly paraffinic crude oil such as a Pennsylvania or Eastern crude or a highly naphthenic crude oil or mixed crudes by the methods disclosed in U.S. Pat. Nos. 3,494,854; 3,011,972; 3,431,198 and 3,642,610.

To demonstrate the desirable properties of the novel insulating oil of the present invention a series of high current fault tests were conducted. These tests compared a control comprising an ordinary transformer oil of a hydrocarbon base, a silicone oil available from Dow Corning as silicone DC-200, the insulating oil of the present invention (L-1811), and a widely used polychlorinated biphenyl. The experiment was conducted as follows:

Approximately four gallons of each fluid were placed in separate cylindrical containers and preheated at 150° C. Each container had fused internal electrodes mounted on the end of SBT Bushings. The electrodes were shaped upward with an expanding gap; this produced an effect which forced the arc upward and into the gas space, where it was present in the gases and vaporized fluids as they were blown out of the test container.

The test results may be summarized as follows:

TEST NUMBER ONE - TRANSFORMER OIL

This test was expected to be violent in nature and was placed in the series as a control sample; results met expectations.

The test current applied was 4820 amperes at 4800 volts. The back-up fuse cleared the fault after 10½ cycles.

The explosion was very violent with an initial fireball, orange and yellow in color, approximately 20 feet high by 15 feet in diameter. This mushroomed into a cloud of flame and smoke approximately 55 feet high by 40 feet in diameter. The resulting smoke cloud produced was voluminous and black to dark grey in color.

The test container and surrounding area were covered with burning liquid which was manually extinguished quickly to avoid damage to the test cable and connectors.

TEST NUMBER TWO - SILICONE FLUID DC-200 (50 CS) (DOW CORNING).

This fluid has been approved for use as a PCB substitute in Japan.

The test current applied was 4760 amperes at 4800 volts. The back-up fuse did not blow. The fault self-cleared after 4½ cycles.

Compared to test one, the explosion and the noise produced were mild. A fireball, orange and yellow in color, approximately 30 feet high by 15 feet in diameter was noted. The flash appeared to be very bright in comparison to the other tests.

The smoke produced was white in color and of less volume than test one. Black flakes were seen in the cloud. White particles, identified as silica, were noted floating in the air after the explosion. The flame was of low magnitude and very quiet in nature, and it burned for a few seconds in the test container after the explosion then self-extinguished.

TEST NUMBER THREE - INSULATING OIL OF PRESENT INVENTION (L-1811)

The test current applied was 4700 amperes at 4800 volts. The fault self-cleared after 4 cycles. The explosion was mild in comparison to test one and resulted in a fireball approximately 15 feet high by 10 feet in diameter. A quantity of nonburning fluid was noted preceding the fireball upward. The smoke was grey-white in color and similar in volume to the smoke cloud of test number two. Noise was mild compared to test one.

A restrike occurred approximately 115 cycles after the initial fault. This was cleared by the back-up fuse.

It could be theorized that possibly the secondary flashover extinguished the flame; however, a review of films taken show that oil burning in the test container after the restrike did self-extinguish.

TEST NUMBER FOUR - PCB

The PCB used in the test was Interteen 70-30 which is available from Monsanto Chemical Company. The test current was 4660 amperes at 4800 volts. The back-up fuse cleared the circuit after 11½ cycles.

A fireball of bright orange flame, approximately 25 feet high by 15 feet in diameter, rose in a pitch black smoke cloud for 1½ seconds after the explosion; black stringers were noted falling from the cloud. There was no fire in or around the test sample.

The smoke cloud was voluminous, approximately 25 feet high by 40 feet in diameter, and remained in the air about 20 feet above the ground for approximately 5–10 minutes before dissipating. The test site and equipment were covered with black fluid and the area had a very noxious odor.

From the results of the test it is obvious that the PCB fluids although they do not burn themselves produce gases that do and in addition produce a dense smoke which constituted a dangerous by-product of considerable magnitude. The results also indicated that both the silicone fluid and the novel insulating oil of the present invention surpass the PCB's in limiting the unsafe conditions resulting from an internal fault within the fluid and provide suitable alternates for the environmentally hazardous polychlorinated biphenyls.

Further it is noteworthy that the test, which was designed to determine the flammability of the liquids after an explosion, demonstrates that both the silicone oil and the insulating oil (1811) are self-extinguishing. This would, of course, limit the after effects of an explosion and allows electrical equipment filled with these fluids to be mounted inside building structures provided reasonable precautions are taken. Both the silicone oil and the insulating oil of the present invention limit the duration of the fault and self-clear. This is a property which is a desirable feature for designs requiring submerged high voltage fuses, breakers and switching devices. In the insulating oil of the present invention there was a restrike, however, this can be explained by the loss of fluid in the test container due to the placement of the arc and physical dimensions of the container. The fluid self-cleared and the electrodes were still energized as the remaining fluid began to settle in the container.

The fluid properties of the insulating oils before and after the arcing test are shown in Table I.

TABLE I

Fluid Properties - Before and After Tests

| | | Dielectric Strength (kV) ASTM D87 | IFT (dyne/cm) ASTM D971 | Viscosity (SSU) ASTM D88 |
|---|---|---|---|---|
| Transformer Oil | Before Test | 32 | 49.0 | 58 sec at 25° C |
| | After Test | 20.4 | 45.5 | 77.4 sec at 25° C |
| Silicone Fluid DC-200 | Before Test | 42 | 20.8 | 50 sec at 25° C |
| | After Test | 15.5 | 22.2 | 66.0 sec at 25° C |
| L-1811 | Before Test | 34 | 25.5 | 1568 sec at 100°F |
| | After Test | 24.5 | 50.0 | 834 sec at 100° F |
| PCB | Before Test | 35 | 50 | 54 sec at 25° C |
| | After Test | 7 | 54.5 | 66.0 sec at 25° C |

The data in the above table reflects the remaining dielectric integrity of the fluids after high current arcing and demonstrates that the insulating oil of the present invention is superior to both the control transformer oil and the PCB liquid.

Tests to establish compatability and thermo studies also were conducted and these studies indicate that the described insulating oil is an excellent dielectric liquid for use in transformers and other high voltage equipment at moderate ambient temperatures of 0° to 40° C.

Compositions falling within the scope of the present invention, if desired, may contain relatively small amounts of conventional chemical additives. For example, pour depressants may be used to lower the pour point of the oil. A particularly suitable class of pour point depressants are those sold under the trademark PARAFLOW. These additives are complex condensation products of paraffin wax and naphthalene which are prepared by chlorinating the wax and condensing the same with naphthalene by the Friedel-Crafts reaction. Although the compositions of this invention possess extremely good oxidation stability, it may be desirable in some instances to increase the stability in which event conventional oxidation inhibitors such as dibutyl paracreosol may be employed.

The insulating oil is introduced into the transformer under vacuum impregnating conditions. The coil and cores are heated to 120° C, placed in an impregnating tank and a vacuum drawn on the tank until an absolute pressure of 6mmHg is attained. Then sufficient oil is introduced to cover the core and coil. At this time the vacuum is removed and the pressure in the tank restored to atmospheric pressure to force the oil into the apparatus.

It will be readily apparent to those skilled in the art that although the preferred use of our unique insulating oil has been described in connection with the transformer, the use of the oil is not so limited. Obviously, the oil can be used in any electrical apparatus utilizing an insulating oil, including capacitors and safety and operational devices, including submerged high voltage fuses, breakers and switches. From the foregoing it will be obvious that I have made a truely surprising discovery that hydrocarbon oils of the defined composition and properties are remarkably safe insulating oils.

It will be obvious to those skilled in the art that various modifications may be made to the compositions of this invention without departing from the spirit and scope of the invention.

I claim:

1. The method of minimizing the detrimental effects that can result in oil filled electrical apparatus during high fault conditions which comprises employing as an insulating oil in such electrical apparatus a relatively nonflammable and biodegradable oil consisting essentially of a saturated hydrocarbon oil having an average molecular weight of about 500 to about 700 and a fire point above 200° C, which oil is liquid throughout the temperature range of 0° to 40° C.

2. The method of claim 1 in which the saturated hydrocarbon oil is selected from oils consisting essentially of (a) straight and branch chain aliphatic hydrocarbons,
(b) naphthenic hydrocarbons, and
(c) mixtures of (a) and (b).

3. The method of claim 1 in which the oil consists essentially of straight and branch chain aliphatic hydrocarbons.

4. The method of claim 1 in which the oil consists essentially of naphthenic hydrocarbons.

5. In an electrical apparatus comprised of an oil tank, an electrical component in the tank and an insulating oil filling said tank, the improved insulating oil which minimizes the detrimental effects that can result during high fault conditions and consists essentially of a saturated hydrocarbon oil having an average molecular weight of about 500 to about 700 and a fire point above 200° C, which oil is liquid throughout the temperature range of 0° to 40° C.

6. The electrical apparatus of claim 5 in which the oil is selected from oils consisting essentially of (a) straight and branch chain aliphatic hydrocarbons, (b) naphthenic hydrocarbons, and (c) mixtures of (a) and (b).

7. The electrical apparatus of claim 5 in which the insulating oil consists essentially of straight and branched chain aliphatic hydrocarbons.

8. The electrical apparatus of claim 5 in which the insulating oil consists essentially of naphthenic hydrocarbons.

9. In the method of impregnating an electrical apparatus with an insulating oil under vacuum, the improvement which comprises utilizing as the impregnating insulating oil a relatively nonflammable, environmentally safe biodegradable oil having a fire point above 200° C, said oil being a liquid consisting essentially of saturated hydrocarbons having an average molecular weight of about 500 to about 700.

* * * * *